US007201830B2

(12) United States Patent
Mojana et al.

(10) Patent No.: US 7,201,830 B2
(45) Date of Patent: Apr. 10, 2007

(54) ANODE FOR OXYGEN EVOLUTION AND RELEVANT SUBSTRATE

(75) Inventors: Corrado Mojana, Valmadrera (IT); Ulderico Nevosi, Milan (IT)

(73) Assignee: De Nora Elletrodi S.p.A. (IT)

( * ) Notice: Subject to any disclaimer, the term of this patent is extended or adjusted under 35 U.S.C. 154(b) by 371 days.

(21) Appl. No.: 10/503,277

(22) PCT Filed: Mar. 13, 2003

(86) PCT No.: PCT/EP03/02643

§ 371 (c)(1),
(2), (4) Date: Jul. 29, 2004

(87) PCT Pub. No.: WO03/076693

PCT Pub. Date: Sep. 18, 2003

(65) Prior Publication Data

US 2005/0109614 A1 May 26, 2005

(30) Foreign Application Priority Data

Mar. 14, 2002 (IT) ..... MI2002A0535

(51) Int. Cl.
*C25B 11/10* (2006.01)

(52) U.S. Cl. ..... 204/290.01; 204/290.12; 204/290.14; 204/242; 204/247; 204/252; 204/280; 205/205; 205/206; 205/208; 205/210; 205/212; 205/214; 205/219

(58) Field of Classification Search ..... 204/247, 204/242, 290.01, 290.12, 290.14, 280; 205/205, 205/206, 208, 210, 212, 214, 219
See application file for complete search history.

(56) References Cited

FOREIGN PATENT DOCUMENTS

EP 1 162 288 A1 12/2001
EP 1162288 A1 * 12/2001

OTHER PUBLICATIONS

XP-002178481 (1 PG), 1998, Derwent Pub.

* cited by examiner

*Primary Examiner*—Bruce F. Bell
(74) *Attorney, Agent, or Firm*—Charles A. Muserlian

(57) ABSTRACT

The invention concerns an anode for gas evolution in electrochemical applications comprising a titanium or other valve metal substrate characterized by a surface with a low average roughness, having a profile typical of a localized attack on the crystal grain boundary. The invention further describes a method for preparing the anodic substrate of the invention comprising a controlled etching in a sulfuric acid solution.

25 Claims, 5 Drawing Sheets

ANODE FOR OXYGEN EVOLUTION AND RELEVANT SUBSTRATE

This application is a 371 of PCT/EP03/02643 filed Mar. 13, 2003.

BACKGROUND OF THE INVENTION

There are several industrial applications known in the art, either of electrolytic or electrometallurgical nature, that make use of anodes whereupon the evolution of a gaseous product takes place, whose achievement constitutes in some cases the primary aim of the process (as for the chlorine evolved in the electrolysis of alkaline chlorides or hydrochloric acid). In other cases, the evolved gas is just a by-product of the reaction (as in the case of oxygen evolved in the processes of metal cathodic electroplating, typical of the galvanic industry). In both cases, one of the primary objects in the realisation of electrodes for gas evolution, and in particular of the anodes, is the high electrochemical activity, that must allow operating with the lowest possible overvoltages in order to increase the global energetic efficiency of the process. It is therefore common practice, also in case the gas developed on an electrode surface is just a by-product, to carry out such reactions on catalytic surfaces. Since the materials with the best electrocatalytic properties are very expensive, such a category fundamentally comprising the platinum group metals and their oxides, their employment is common only as thin superficial layers, coated on a conductive matrix. In particular, it is widely known to the experts in the art the use of metallic substrates coupling good current conduction and corrosion resistance features, having at least one surface coated with a thin layer of noble metals and/or oxides or alloys thereof; embodiments of this kind are for instance disclosed in U.S. Pat. No. 3,428,544, No. 3,711,385, and many others. The corrosion resistance of the metallic substrate is a very critical parameter especially in the case of electrodes destined to function as anodes, where the aggressiveness of the electrolytes is further favoured by the electrochemical working potential. For this reason, the anodes for industrial electrolytic and electrometallurgical applications are preferably realised starting from substrates of valve metals, that is metals resisting to corrosion for being protected by a thin superficial film of inert oxide. Among these, the metal most often employed is by far titanium, for reasons of cost and workability. The electrochemical characteristics of titanium matrixes coated with noble metal oxide based catalysts are normally considered more than satisfying as gas evolving anodes for nearly all the industrial electrochemical applications. Conversely their lifetime, especially in the most critical working conditions (highly aggressive electrolytes, very high current density, etc.) constitutes, in many cases, a problem not yet fully solved, although a rich literature exists by now testifying some fundamental progresses in this field. A high duration of the electrodes is a fundamental condition for the industrial success of the electrochemical applications, not only because, in case of deactivation, a new electrochemical coating, inherently expensive both in terms of material and of manpower, must be deposited, but also for the missed production associated to the plant shut-downs required for the replacement of the electrodes. Since the noble metals used in the formulation of electrocatalytic coatings are per se immune from corrosion in the usual operating conditions, the prevailing cause of deactivation consists in the local detachment of the coating from the substrate, with consequent corrosion or passivation of the latter. Such detachment is favoured from the gas evolution itself, due to the mechanical action of the bubbles formed on the surface, and the phenomenon is further emphasised at high current density. In particular, in some electrometallurgical applications with anodic oxygen evolution, for instance in the zinc plating of sheets for use in the car industry or in the production of thin copper sheets for use in the electronic industry, anodic current densities exceeding 15 kA/m$^2$ are reached.

A further factor of instability for the adhesion of the coating to the substrate may derive from the porosity of the former, allowing the infiltration of electrolyte in direct contact with the unprotected metallic matrix. In such cases, in particular if zones of detachment exist even if microscopic, passivation of the substrate can occur, with formation of an often scarcely conductive oxide interposed between substrate and electrocatalytic coating, without the physical detachment of the latter taking place. To obtain a sufficient anchoring of the electrocatalytic coating to the substrate the usefulness of conferring a certain roughness to the substrate itself, for instance by means of a sandblasting treatment, or by controlled etching with a corrosive agent, is widely known since the origin of this type of electrodes. The superficial roughness favours the mutual penetration of the substrate and the catalyst, obtained through the thermal treatment of a precursor applied to the substrate in form of a paint. In the case of titanium for instance, abrasive treatments with sand, sand mixed to water or corundum, and etching with hydrochloric acid are well established; such procedures allow obtaining electrodes which find a possible use in some industrial applications, notwithstanding the necessity of submitting the electrodes to a still rather frequent periodic reactivation. Among the most penalised applications, the electrometallurgical processes with anodic evolution of oxygen should again be cited, especially in case operation at current density higher than 10 kA/m$^2$ is required. Also for low current density processes however, as in the case of electrowinning in acidic environment of metals from solutions deriving from ore dissolution, problems subsist, albeit of a different kind; among them, the impurities always present in the electrolytic baths, some of which have an extremely deleterious effect on the passivation of titanium matrixes. A classic example is given by fluoride ions, capable of complexing titanium thereby destroying the protective film with consequent attack of the underlying metallic matrix, especially in zones where microdefects in the adhesion of the electrocatalytic coating to the substrate are already present.

The employment of intermediate coatings with adequate characteristics of corrosion inhibition to be interposed between metallic substrate and electrocatalytic coating has been thus repeatedly proposed under different forms, so that the corrosive attack in correspondence of the always present micro-defects is stopped in correspondence of such barrier. An example of intermediate coating, based on ceramic oxides of valve metals, is disclosed in the European Patent EP 0 545 869, but several other types of intermediate coating, mainly based on transition metal oxides, are known in the art.

The definition of the optimal roughness parameters of electrodic matrixes suited to receive an electrocatalytic coating is for instance disclosed in the European Patent EP 0 407 349, assigned to Eltech Systems Corporation, USA, wherein it is specified that, in order to achieve a good quality adhesion of the coating itself, it is necessary to impart a superficial average roughness not lower than 250 microinches (about 6 micrometres), with an average of at least 40 peaks per inch (on the basis of a profilometer upper threshold of 400 microinches, that is about 10 micrometres, and of a lower threshold of 200 microinches, that is about 8 micrometres).

The finding disclosed in EP 0 407 349 constitutes a step forward toward the definition of an electrode with improved characteristics of potential and duration, however it is apparent to the experts of the field that such a high roughness, obtained by means of a severe generalised attack of the surface of chemical or mechanical nature, requires the deposition of catalytic layers of a certain thickness to obtain a sufficiently homogeneous covering. It is a customary practice, known to the experts in the art, the deposition of catalytic layers, independent of the presence of intermediate protective layers, having an overall noble metal loading well higher than 10 g/m$^2$, preferably comprised between 20 and 30 g/m$^2$, for all of the cited industrial (electrolytic and electrometallurgical) applications. In the absence of this, the duration of the anodes for gas evolution is still largely insufficient.

Also the subsequent patent application US-2001-0052468-A1, which provides superimposing a microrough profile on a macrorough profile quite similar to the one of EP 0 407 349, although giving electrodes with superior lifetime characteristics also in the absence of intermediate coatings, is fundamentally directed to electrodes with consistent noble metal loadings (24 g/m$^2$ in the examples). Such high loadings of noble metal are onerous from an economical standpoint, and in some cases they are not acceptable at all: this is especially the case of the primary electrometallurgical applications (electrowinning and similar), where the added value of the products is not high enough to justify such elevated investment costs.

OBJECTS OF THE INVENTION

Under one aspect, it is an object of the present invention to provide an electrode substrate overcoming the inconveniences of the prior art.

Under another aspect, it is an object of the present invention to provide an electrode substrate allowing to produce gas evolving anodes with improved characteristics of catalytic coating adhesion.

Under a further aspect, it is an object of the present invention to provide an electrode substrate allowing to produce a gas evolving anode with improved lifetime characteristics even in presence of catalytic coatings with a reduced noble metal loading with respect to the prior art.

Under a further aspect, it is an object of the present invention to provide a method for the preparation of an electrode substrate and of a relevant gas evolving anode with improved lifetime characteristics.

DESCRIPTION OF THE INVENTION

Under a first aspect, the invention consists of a valve metal, preferably titanium, electrode substrate, with low average roughness, in particular with average roughness Ra comprised between 2 and 6 micrometres, deriving from a localised attack on the crystal grain boundary.

Under another aspect, the invention consists of a gas evolving anode for electrochemical applications consisting in a low roughness valve metal substrate, said roughness deriving from a localised attack of the crystal grain boundary, coated with a catalytic layer based on noble metals, with an optional protective layer, wherein said coating layers penetrate within the grain boundaries subjected to the localised attack thereby covering the substrate, and wherein the final roughness after the coating application is preferably comprised between 2 and 4.5 micrometres.

Under a further aspect, the invention consists of a method for the preparation of a valve metal electrode substrate with low roughness, said roughness deriving from a localised attack of the crystal grain boundary, comprising a step of controlled etching in a medium achieving a specific attack of the grain boundary; for this purpose, the preferred medium for the attack is sulphuric acid, but other acids such as perchloric add and mixtures of hydrofluoric acid with nitric acid are suited to the scope.

With the aim of facilitating the understanding of the invention, the latter will be described making reference to the annexed figures, which have merely an exemplifying purpose and do not intend by any means to constitute a limitation of the same.

DETAILED DESCRIPTION OF THE INVENTION

Figure 1:
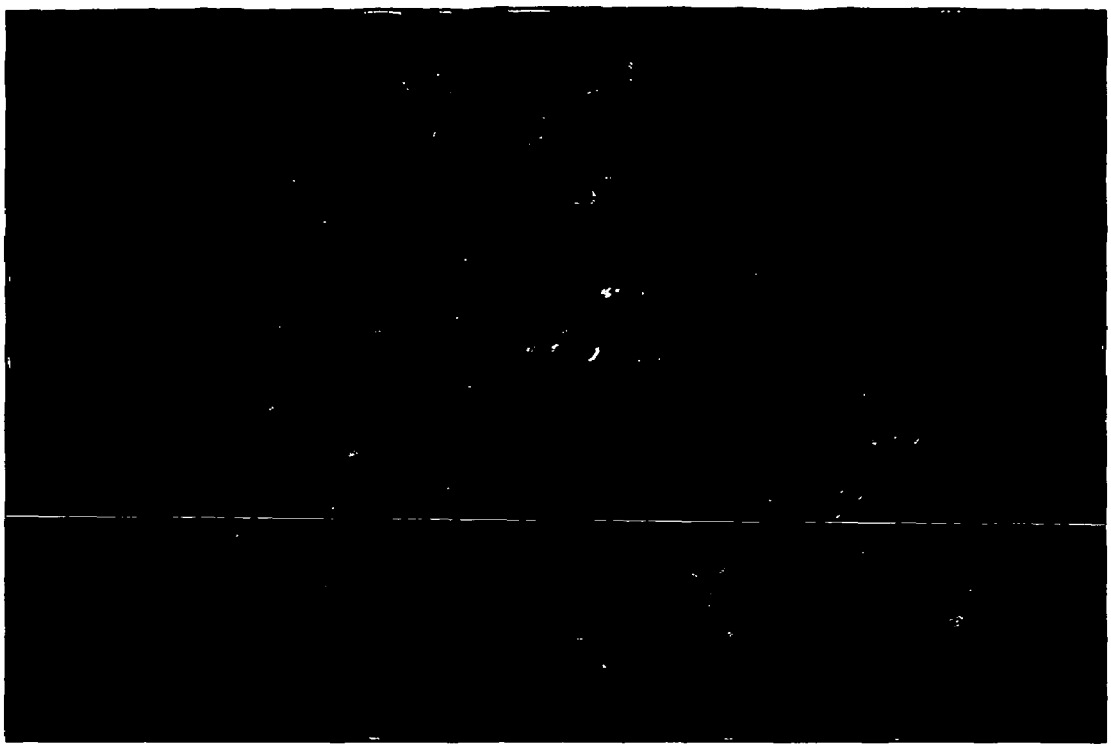
FIG. 1 shows a top view of the surface of a titanium electrode substrate according to the invention.

Contrarily to the teachings of the prior art, it has been surprisingly observed that the anodes for gas evolution in electrochemical applications may be advantageously obtained from substrates of valve metal, preferably titanium, having a very low average roughness, in any case not higher than 6 micrometres, provided such roughness is conveniently localised. In particular, the optimal roughness must be obtained starting from a metal of not too high average crystal grain size (preferably comprised between 20 and 60 micrometres, and even more preferably between 30 and 50 micrometres), by means of a preferential attack of the external surface localised in correspondence of the boundary of said crystal grains. In a preferred embodiment, the crystal grain boundary of a titanium surface to be used as electrode substrate is attacked, for instance by means of an acid etching, removing a certain amount of metal in correspondence of the boundaries of the grains without completing the detachment of the latter. In a still more preferred embodiment, such attack which removes metal from the superficial crystal grain boundary has a depth of penetration corresponding to about half the depth of the grain, and in any case comprised between 20 and 80% of such depth. As previously said, the anode substrate of the invention is preferably made of pure or alloyed titanium, but the use of other valve metals such as tantalum, niobium or zirconium is also possible. The substrate of the invention can assume any geometry known in the field of gas evolving anodes, and can be for instance a solid or perforated sheet, an unflattened or flattened expanded sheet, a net or other type of mesh, or a rod or bar or combination of rods or bars; other particular geometries are however possible, depending from the requirements of the case. The anode substrate of the invention is usually coated with one or more coating layers, known to the experts in the art. In particular, the application of one or more layers for the protection from corrosion and passivation phenomena is possible; in this case, very thin layers based on transition metal oxides are usually employed, but other types of protective coatings are possible. For the use in practical applications of industrial interest, for instance as regards the anodes for oxygen or chlorine evolution, the substrate is preferably coated, usually in the external part contacting the electrolyte, with a catalytic coating, preferably based on mixtures of noble metals or oxides thereof. Contrarily to the teachings of the prior art, the substrate of the invention permits to obtain an anode with optimal duration characteristics, also in high current density electrochemical processes, with very thin electrocatalytic coatings, limiting the noble metal content even below 10 grams per square meter of active area. It has been surprisingly found, eventually, that the localised attack at the crystal grain boundary, producing a characteristic profile with valleys (negative peaks in the roughness profile) that are distanced in a sufficiently uniform fashion and have a controlled penetration depth, is sufficient to grant an optimum anchoring of the coating penetrating said valleys, also in the absence of a high average roughness, obtained with a generalised surface attack.

It has been even surprisingly found that in the absence of an excessive average roughness, the loading of the coating necessary to uniformly cover the surface of the substrate is pretty much lower, and that the anode can, in this case, operate for long times before passivation or in general deactivation phenomena occur, also with a noble metal content of the outermost coating limited to 5–10 g/m$^2$. Without wishing to bind the extent of the instant invention to any particular theory, it can be hypothesised that, as regards the titanium or other valve metal substrates, the adhesion characteristics of the catalytic or protective coatings are mainly associated to the availability of anchoring points at the grain boundaries, and that the roughness characteristics deriving from a heavy generalised attack create valleys that are rather useless from the adhesion standpoint, moreover entailing the onus of having to be filled with a sufficient amount of coating in order to avoid leaving scarcely covered and easily passivatable zones. A complete anode of the invention, obtained by covering the disclosed substrate with a catalytic coating and an optional protective coating of the state of the art, presents an extremely smooth surface, thus exhibiting an average roughness typically comprised between 2 and 4.5 micrometres.

The preferred method for the preparation of the anode substrate of the invention comprises an etching step with a corrosive medium capable of selectively attacking the grain boundary; the methods disclosed in the state of the art to obtain high roughness provide sandblasting steps, thermal treatments, depositions of matter with plasma technique or etchings with corrosive media such as hydrochloric acid, that are capable of imparting roughness profiles more or less controlled, but in any case generalised on the whole surface. It has been surprisingly found that sulphuric acid mixtures under controlled conditions, and preferably sulphuric acid as an aqueous solution having a concentration of 20 to 30% by weight at a temperature comprised between 80 and 90° C., are able to achieve a specifically localised attack on the grain boundary of valve metals, and in particular of titanium. In a preferred embodiment, the etching bath in which the electrode substrate of the invention is treated also contains a passivating agent, capable of adjusting the attack velocity in such a manner that the desired roughness profile is confidently obtained, that is achieving the grain boundary attack with a penetration depth not lower than 20% of the grain average dimension (so as to avoid obtaining an insufficient anchoring of the coating) and not higher than 80% thereof (so as to avoid causing the detachment of the smallest grains). The presence of a passivating species increases the selectivity of the grain boundary attack, but even more importantly renders the attacking time uniform, allowing an excellent control of the process. As the passivating species, it is possible for example to add iron under ionic form; however the titanium itself, dissolving in the etching bath, can achieve an optimal passivation above a certain concentration (indicatively 2 g/l). It is thus convenient to add a corresponding amount of titanium under ionic form to the etching bath before utilising the same, without exceeding too much as an etching bath containing more than 30 g/l of titanium loses its efficacy and has to be considered substantially exhaust. Titanium may be added as a salt, or more conveniently by dissolving titanium metal until reaching the optimum concentration. It is also possible to use a sulphuric acid bath to etch titanium destined to other uses, and start employing the same for the electrode substrates of the invention once the titanium concentration that allows a suitable control is reached. The substrate of the invention may also be prepared with a sulphuric acid bath free of passivating species, however an accurate check of the roughness profile in subsequent times must be effected, until reaching the required specification. With an etching bath of sulphuric acid in aqueous solution of concentration comprised between 20 and 30% by weight at a temperature comprised between 80 and 95° C., containing titanium at a concentration comprised between 2 and 30 g/l or another equivalent passivating agent, the etching treatment must be preferably carried out for a time comprised between 45 and 120 minutes.

To obtain even more reproducible results, it is preferable to carry out, before etching, a thermal annealing treatment, which in the case of titanium is generally effected between 500 and 650° C. for a time sufficient to uniform the crystal grain size. In order to effect a thorough cleaning of the substrate, especially as regards the renovation of deactivated electrode structures, it is preferable in some cases to carry out also a sandblasting pre-treatment, for instance with corundum or other aluminum oxide based material.

EXAMPLE 1

A sheet of titanium grade 1 according to ASTM B 265, 0.2 cm thick, with a surface of 35 cm×35 cm, was degreased with acetone, rinsed with demineralised water, air-died and subjected to an annealing thermal treatment at 570° C. for two hours; at the end of the treatment, it was studied at the optical microscope to check the crystal grain average size, which resulted to be 35 micrometres. The sheet was then immersed in an aqueous bath of sulphuric acid, prepared from acid of pure grade for batteries, at a concentration of 25% by weight and at a temperature of 87° C. At the beginning of the treatment, the bath contained 5 g/l of titanium expressed as metal. The treatment was protracted for 60 minutes. At the end of the etching, the washed and dried sample was subjected to a roughness determination with a profilometer; the average roughness, measured with a profilometer with a bandwidth around the middle line Pc of ±8 micrometres, resulted to be 4 micrometres.

A new optical microscope investigation, wherefrom the picture reported as FIG. 1 has been obtained, was then effected. A localised attack along the crystal grain boundary is clearly evidenced; the surface of said grains appears instead as virtually not affected by the attack.

Figure 5:
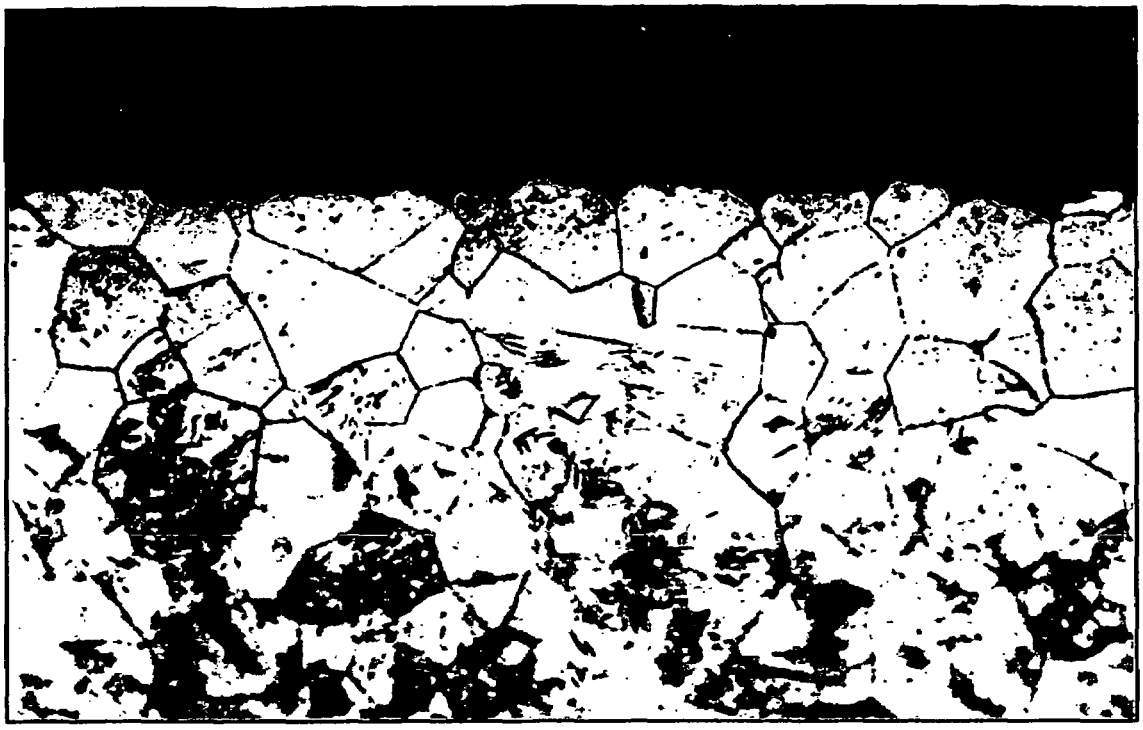
FIG. 5 shows a cross-section of the electrode substrate of the invention of FIG. 1.

The same sample was cut in half to observe its section, reported as FIG. 5; a very regular surface profile is evidenced, with valleys corresponding to the grain boundary. The two resulting halves of the sheet were finally painted to apply a state-of-the-art protective layer, based on titanium and tantalum oxides in 35:65 atomic ratio, and a catalytic coating of iridium and tantalum oxides with a total noble metal loading expressed as sum of elemental Ta and Ir of 5 $g/m^2$.

Figure 7:
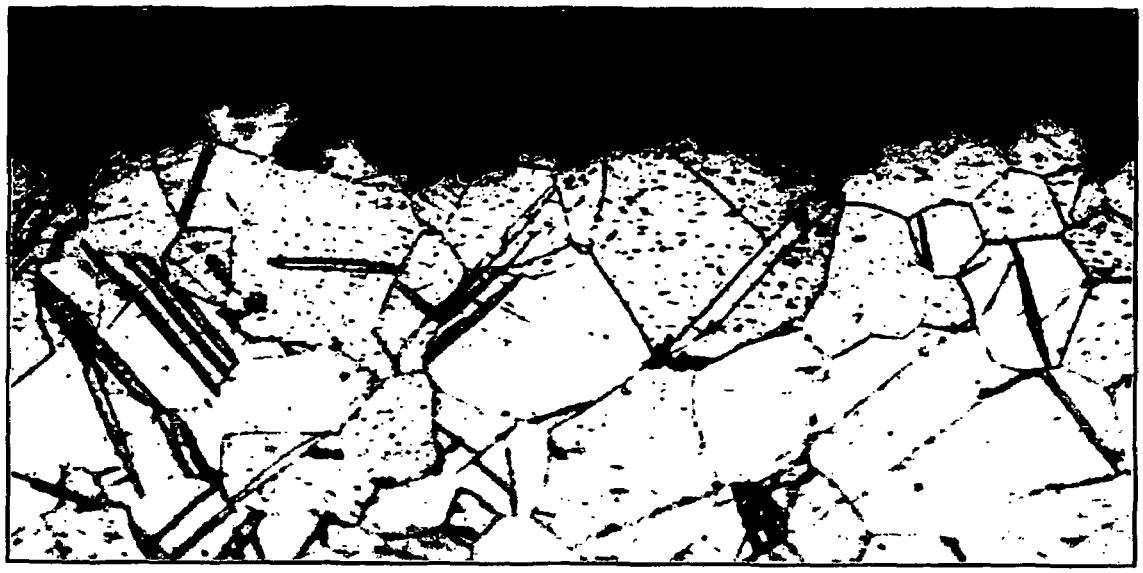
FIG. 7 shows a cross-section of an anode of the invention obtained by application of a catalytic coating to the substrate of FIGS. 1 and 5.

The samples so activated had a residual average roughness of 3.5 micrometres; FIG. 7 shows the section one of these activated samples. The penetration of the catalytic coating inside the valleys corresponding to the crystal grain boundary of the substrate is clearly evidenced.

COUNTER EXAMPLE 1

Figure 2:
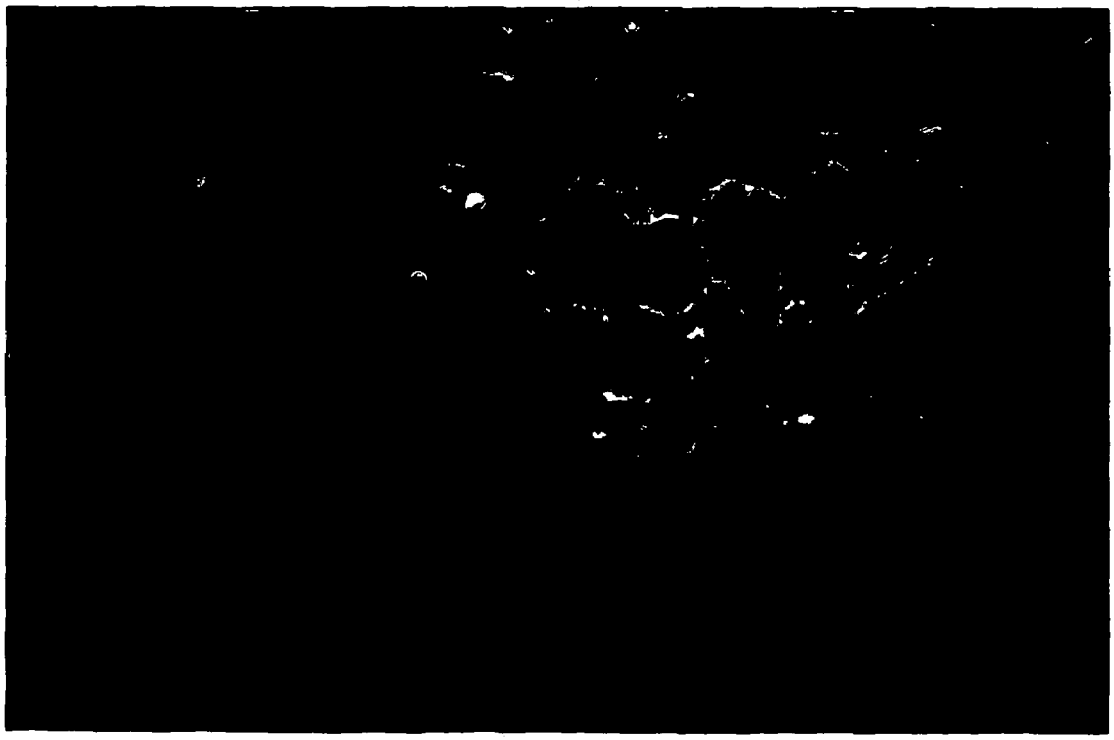
FIGS. 2, 3 and 4 show top views of surfaces of electrode substrates not in accordance to the specifications of the present invention.

The test of example 1 was repeated with an identical sheet, the only variation being that the etching treatment was protracted for just 30 minutes. FIG. 2 shows a picture of its surface after etching, evidencing an inhomogeneous situation, with wide zones not subjected to any attack, alongside others where a slight grain boundary attack is evidenced.

The sheet was activated in the same way as the samples of example 1.

COUNTER EXAMPLE 2

Figure 3:
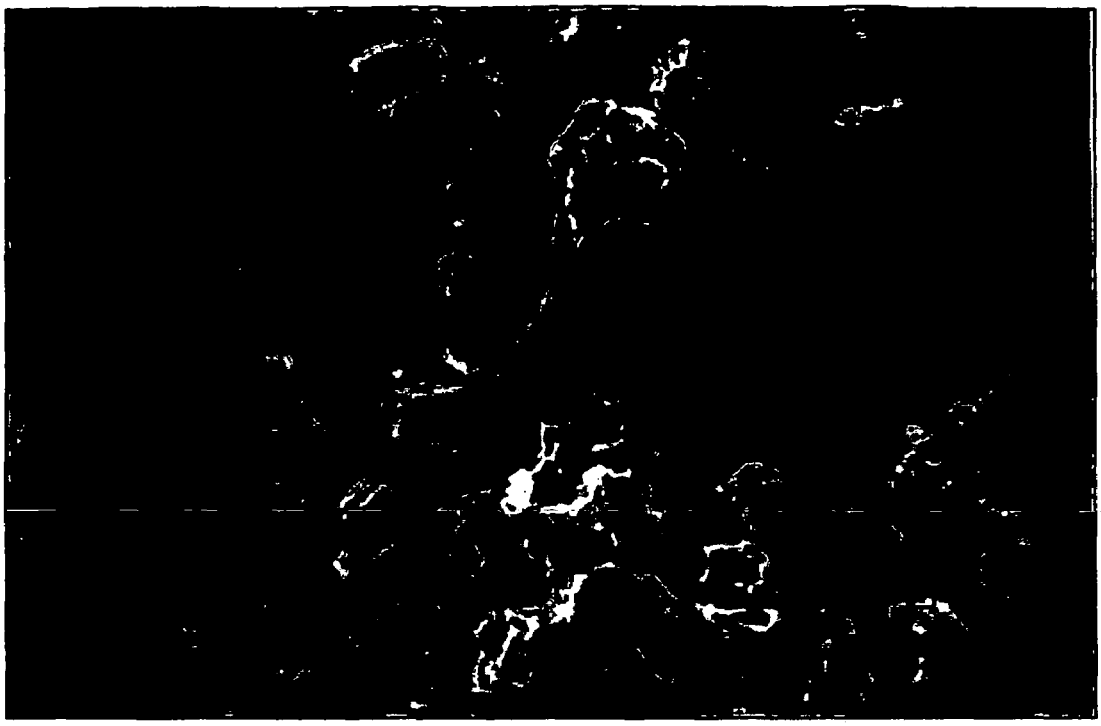
Figure 6:
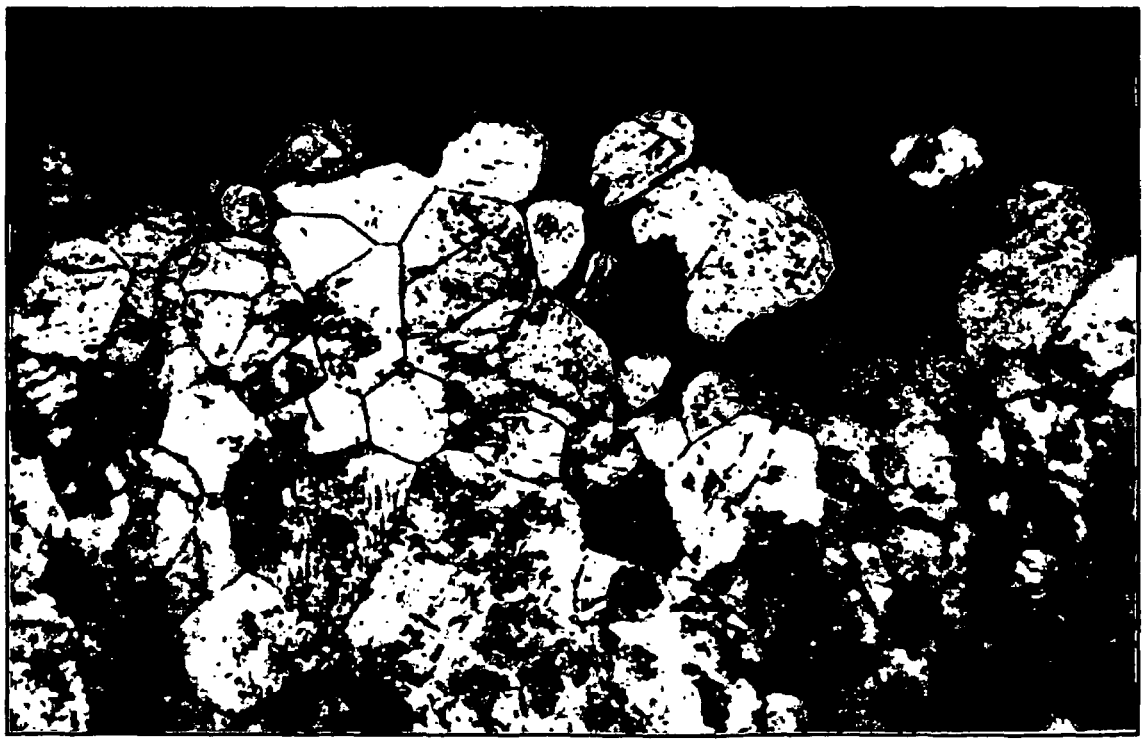
FIG. 6 shows a cross-section of the electrode surface of FIG. 3 not in accordance with the specifications of the present invention.
Figure 8:
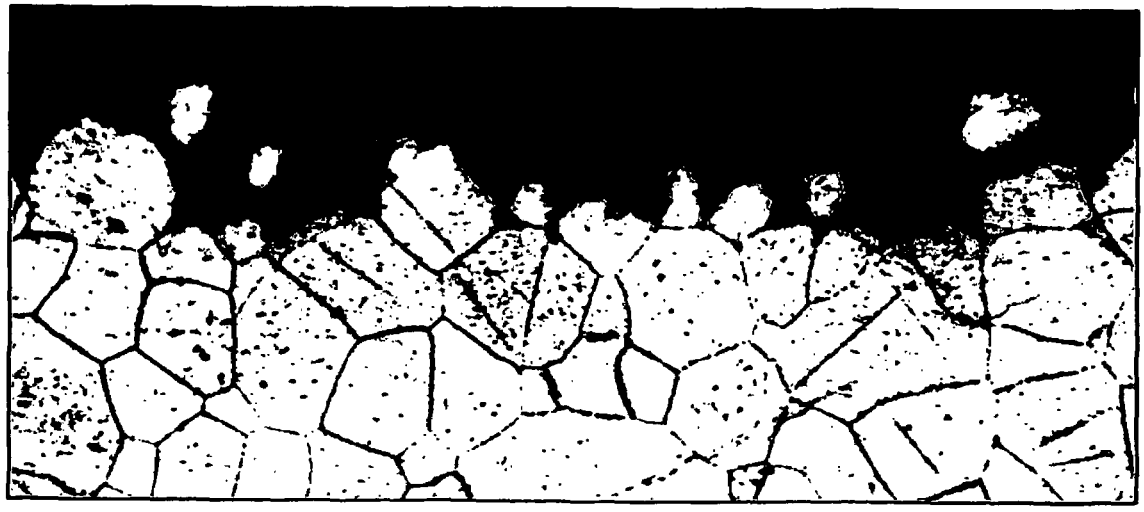
FIG. 8 shows a cross-section of an anode obtained by application of a catalytic coating to the substrate of FIGS. 3 and 6 not in accordance with the specifications of the present invention.

The test of example 1 was repeated with an identical sheet, the only variation being that the etching treatment was protracted for 180 minutes. FIG. 3 shows a picture of its surface after etching, displaying a localised attack on the grain boundary exceeding 80% of the grain average thickness, so that a good percentage of grains results to be completely removed, and the metal is attacked beyond the first row of grains. The same sample was cut in half to observe its section, reported as FIG. 6, wherein a totally irregular profile is evidenced, with several completely removed grains. The two resulting halves of the sheet were painted in the same way as in example 1; FIG. 8 shows a section of an activated sample, evidencing as the coating leaves some grains almost uncovered, penetrating however, in other zones, beyond the whole thickness of the crystal grain which thereby results to be completely embedded. It is evident to the experts in the art as the uncovered zones are immediately subjected to passivation, while those were entirely embedded crystal grains are easily subjected to detachments especially in case of gas evolution at high current density.

COUNTER EXAMPLE 3

Figure 4:
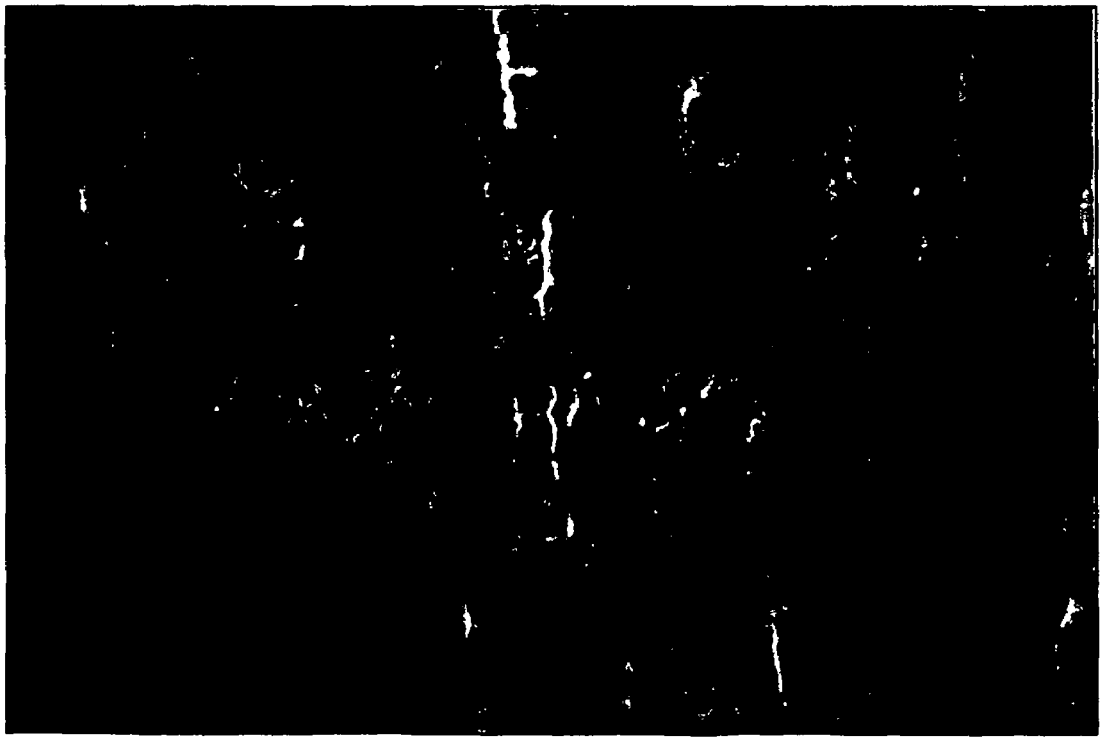

The test of example 1 was repeated, the only variation being that the etching was effected in commercial grade hydrochloric acid, as a 22% by weight aqueous solution, at the boiling point, according to a widespread state-of-the-art procedure. FIG. 4 shows a picture of its surface after etching, evidencing a generalised attack, which doesn't allow visualising the boundary of the single grains.

The sheet was activated in the same way as the samples of example 1.

COUNTER EXAMPLE 4

Figure 9:
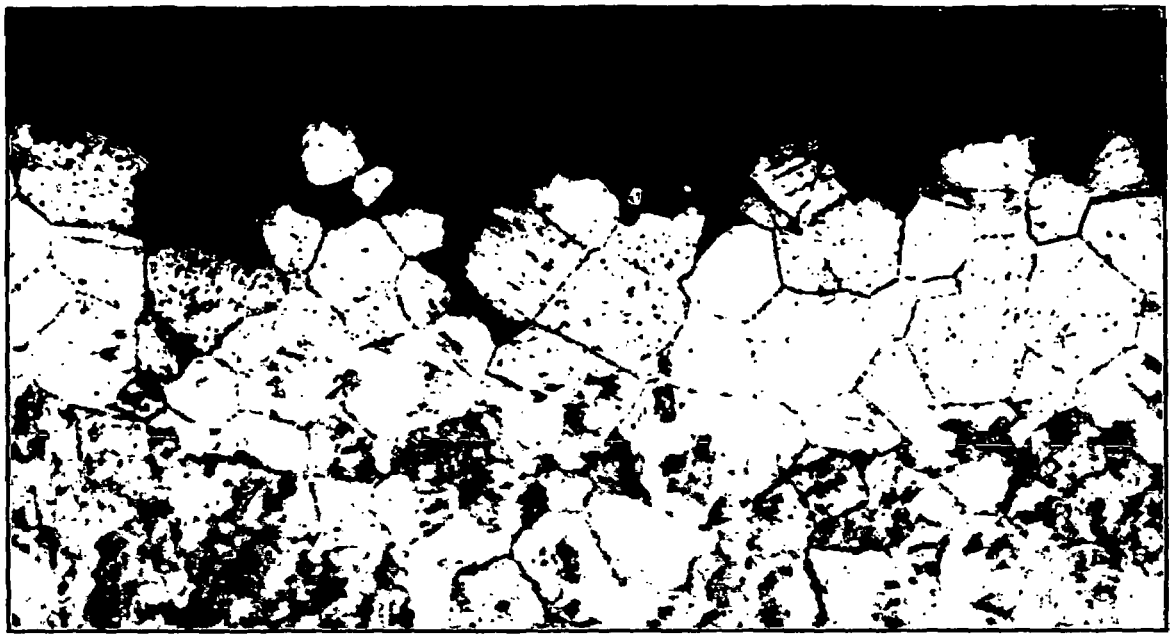
FIG. 9 shows a cross-section of another anode obtained by application of a catalytic coating to an electrode substrate not in accordance with the specifications.

The test of example 1 was repeated, the only variation being that the etching was effected with sulphuric acid free of titanium or other passivating species. FIG. 9 shows a picture of a section thereof after activation, evidencing as the coating leaves some grains almost uncovered, penetrating however, in other zones, beyond the whole thickness of the crystal grain which thereby results to be completely embedded. The situation is practically equivalent, in other words, as that of counter example 2, indicating how, in the absence of passivating species, sulphuric acid presents a much higher aggressiveness than under regimen conditions, with an adequate titanium concentration already present in the bath.

EXAMPLE 2

The activated samples of example 1 and of counter examples 1, 2, 3 and 4 were subjected to a life test, consisting in making them work as oxygen evolving anodes at high current density in an aggressive electrolyte, determining the time of deactivation expressed as hours of operation needed to raise the electrode overpotential beyond a predetermined value. The lifetime value obtained in this kind of tests, where the process conditions are extremely exasperated with respect to those of the industrial practice, allows extrapolating with a certain reliability the duration in the effective processes they are destined to, as known to the experts of the field.

The lifetime test employed consists in using the sample as gas evolving anode in a test cell that performs the electrolysis of a sulphuric acid aqueous solution with a concentration of 150 g/l at 60° C., and at an anodic current density of 30 $kA/m^2$. As the counter electrode, a hydrogen evolving zirconium cathode of large area is employed, which works thereby at very low current density and whose potential is substantially constant during the test. The initial cell voltage in these conditions is about 4.5 V; the anode is considered deactivated when such cell voltage reaches a conventional value of 8 V.

The two activated samples of example 1 (anodes obtained from the substrate of the invention) showed, in these conditions, a duration comprised between 3500 and 4200 hours; the two samples of counter example 1 (substrate insufficiently attacked in the etching phase) showed a duration comprised between 900 and 1080 hours; the two samples of counter example 2 (substrate excessively attacked in the etching phase) showed a duration comprised between 1500 and 1900 hours; the two samples of counter example 3 (substrate etched in hydrochloric acid and subjected to a generalised attack) showed a duration comprised between 1200 and 1400 hours; the samples of counter example 4 (substrate excessively attacked in the etching phase) showed a duration comprised between 1700 and 1850 hours.

The invention claimed is:

1. A valve metal electrode substrate for gas evolving anodes, said metal substrate being provided with a structure made of crystal grains, comprising at least one surface with a roughness profile characterized by an average roughness Ra comprised between 2 and 6 micrometers as measured with a profilometer with an average bandwidth around the middle line Pc of ±8.8 micrometers, said roughness profile being comprised of peaks mostly located in correspondence of the boundary of said crystal grains.

2. The electrode substrate of claim 1 wherein said average roughness is comprised between 2.5 and 4.5 micrometers.

3. The electrode substrate of claim 1 wherein the valve metal comprises titanium.

4. The electrode substrate of claim 1 wherein the crystal grain average size is comprised between 20 and 60 micrometers.

5. The electrode substrate of claim 4 wherein the crystal grain average size is comprised between 30 and 50 micrometers.

6. The electrode substrate of claim 1 wherein the depths of said peaks coinciding with the crystal grain boundary is comprised between 20 and 80% of the average size of said crystal grains.

7. The electrode substrate of claim 1 is selected from the group consisting of solid sheets, perforated sheets, flattened and unflattened expanded sheets, rods and bars.

8. An anode for gas evolution in electrochemical cells comprising the electrode substrate of claim 1 and at least one coating applied to said at least one surface with an average roughness Ra comprised between 2 and 6 micrometers.

9. The anode of claim 8 wherein said at least one coating penetrates in said roughness peaks corresponding to the crystal grain boundary.

10. The anode of claim 8 wherein said at least one coating has a thickness not exceeding the crystal grain average size.

11. The anode of claim 8 wherein said at least one coating comprises at least one catalyst.

12. The anode of claim 11 wherein said at least one catalyst comprises a noble metal or mixture of noble metals, pure or as oxides, with electrocatalytic properties toward oxygen evolution from aqueous solutions.

13. The anode of claim 12 wherein the total noble metal loading is lower than 10 $g/m^2$.

14. The anode of claim 11 wherein between said at least one surface with average roughness Ra comprised between 2 and 6 micrometers and said at least one coating comprising at least one catalyst, a further coating having a protection function is interposed, penetrating into said roughness peaks generally corresponding to the crystal grain boundary.

15. The anode of claim 14 wherein said further coating comprises transition metal oxides.

16. The anode of claim 8 wherein the average roughness Ra of said at least one surface after the application of said at least one coating is comprised between 2 and 4.5 micrometers.

17. A method for the preparation of the electrode substrate of claim 1 comprising a step of controlled etching in a bath containing at least one medium of preferential corrosion of the boundary of said crystal grains.

18. The method of claim 17 wherein said at least one medium comprises sulfuric acid.

19. The method of claim 18 wherein said sulfuric acid has a concentration comprised between 20 and 30% by weight at a temperature comprised between 80 and 95° C.

20. The method of claim 19 wherein said sulfuric acid is added with a passivating species.

21. The method of claim 20 wherein said dissolved passivating species is titanium proceeding from a previous etching or added separately, at a concentration comprised between 2 and 30 g/l.

22. The method of claim 17 wherein said etching treatment has a duration of between 45 and 120 minutes.

23. The method of claim 17 wherein said etching step is preceded by at least one treatment selected from a thermal annealing at a temperature comprised between 500 and 650° C. and a sandblasting.

24. The method of claim 23 wherein said sandblasting is carried out with an aluminum oxide.

25. In an electroplating cell, the improvement comprising using as an oxygen evolving anode that of claim 8.

* * * * *